US006220960B1

(12) United States Patent
Kryzhanovsky

(10) Patent No.: US 6,220,960 B1
(45) Date of Patent: Apr. 24, 2001

(54) METHOD AND APPARATUS FOR SELECTING JOKER CARD IN POKER GAME

(76) Inventor: Alexandr Alexandrovich Kryzhanovsky, d.8, kv.16, Moskovskaya (RU)

( * ) Notice: Subject to any disclaimer, the term of this patent is extended or adjusted under 35 U.S.C. 154(b) by 0 days.

(21) Appl. No.: 09/438,546

(22) Filed: Nov. 12, 1999

(30) Foreign Application Priority Data

Dec. 24, 1998 (RU) ..... 98123460

(51) Int. Cl.[7] ..... A63F 13/00
(52) U.S. Cl. ..... 463/13; 463/20; 273/292
(58) Field of Search ..... 463/20, 13, 9; 273/292

(56) References Cited

U.S. PATENT DOCUMENTS 4,836,553 * 6/1989 Suttle et al. ..... 273/292
5,288,081 * 2/1994 Breeding ..... 273/292
5,308,065 * 5/1994 Bridgeman et al. ..... 273/85 CP
5,332,228 * 6/1994 Schultz ..... 273/292
5,669,817 * 9/1997 Tarantino ..... 463/13
5,868,619 * 2/1999 Wood et al. ..... 463/13
5,947,821 * 9/1999 Stone ..... 463/13
5,957,774 * 9/1999 Holmes, Jr. et al. ..... 463/13
5,971,849 * 10/1999 Falciglia ..... 463/16

* cited by examiner

*Primary Examiner*—Steven Wong
*Assistant Examiner*—D Collins
(74) *Attorney, Agent, or Firm*—Pennie & Edmonds LLP

(57) ABSTRACT

The present invention relates to poker game and discloses a method of selecting a joker card after each player makes an ante and is dealt five cards. A joker card is selected at random from a plurality of elements, each corresponding to one of the cards of the deck. Players view their hands and then decide whether to continue playing or to fold, basing their judgments on the available game combinations and on the random-selected joker card intended to increase the rank of a game combination. If the game is continued, the players' game combinations are compared with one another in accordance with the rank order of winning poker hands, account being taken of the possibility of getting the highest winning hand of five cards of the same suit. The invention makes it possible to modify the traditional five-card stud poker game by introducing, without jeopardizing the poker game protection, one of the already available 52 cards as a wild card (joker) which is changed with every new hand. A random symbol, e.g. a picture of the selected card, is presented to the players on an electronic display.

19 Claims, 2 Drawing Sheets

METHOD AND APPARATUS FOR SELECTING JOKER CARD IN POKER GAME

BACKGROUND OF THE INVENTION

The present invention generally relates to the entertainment industry and game business. More specifically, it relates to a game of chance that can be played in a casino version or a cardroom version. It covers a method and an apparatus for selecting a joker card in a poker game.

A five-card stud poker game has fascinated the public for years. A wide network of poker clubs and numerous poker tournaments is convincing testimony to its popularity. The number of poker game versions runs into dozens and is continuing to grow. Five card stud, Seven card stud poker, Draw poker, Texas hold'em—all these and other modified versions use the same basic priority or rank order of winning poker hands.

Till quite recently poker was exclusively a club game, i.e. a game in which the players play among themselves. It was practiced in cardrooms and casinos where the house provided facilities for the game and, if necessary, a croupier. The house only collected a commission of each player's winning to compensate the house for providing the service to the players and did not participate in the game.

For this reason, despite its obvious popularity, the poker game was for a long time unable to receive status and rise to the rank of a casino table game adapted for game houses and casinos in which the players could play against an impersonal party, the house or the casino, rather than against their fellow player.

U.S. Pat. No. 4,836,553 proved a veritable revolution in the game industry as it offered a poker game variant acceptable to a casino. The game which came to be known as Carribean Stud Poker practically spread throughout the world. Its later modifications are Oasis Stud Poker (the European version of Carribean Stud), Let it Ride (based on Texas hol'em), Three Card Poker, and others.

In order to heighten the players' interest in the game, attempts were made to change some poker rules and, wherever possible, to increase odds. Specifically, the practice of exchanging one, two and more cards for an additional wager in Oasis Stud Poker proved to be a very effective innovation. In some casinos players may "buy" an extra card for the croupier when the player has a very good combination, and the croupier does not qualify. This modification approximates Draw Poker.

One would expect that the next step along this line would be to include an extra playing card (the so-called joker card) in the 52-card deck which would increase the number of game combinations, add to the thrill of the game and bring it as close as possible to the classic version in which the highest rank combination is not Royal Flush, but a Five of a Kind. Yet no casino in the world could accept this innovation for one very simple reason: the introduction of an extra card in the deck as a joker would immediately make the game very vulnerable to all sorts of cheating. A marked joker card capable of increasing the rank of any available combination may prove to be ruinous to the casino or poker club owners.

SUMMARY OF THE INVENTION

It is an object of the present invention to provide a method and an apparatus for selecting a joker card in a poker game whereby the introduction of said joker card does not jeopardize the poker game safety.

It is another object of the present invention to provide a method and an apparatus for selecting a joker card whereby the number of game combinations increases and the game approximates the classic poker version with a possibility of the Five of a Kind combination.

According to the invention, these objects are accomplished by a method of selecting a joker card for a poker game comprising the steps of:

(a) all players anteing a first bet means;

(b) a croupier dealing a certain number of cards to the players;

(c) one of the players selecting a joker card for a given hand by picking out at random one of the elements from a plurality of elements, each corresponding to one of the cards in the deck;

(d) each player viewing his hand and deciding whether to continue playing or to fold depending on the game combination available to him and the possibility of the random-selected joker card to increase the rank of his game combination;

(e) each player either folding or remaining to continue the game;

(f) each remaining player assessing the remaining players' game combinations on the basis of the established priority or rank order of winning poker hands;

(g) each remaining player estimating his gain in the case of a winning hand, assessing the possibility of getting a new game combination of the highest rank (Five of a Kind), and paying his bet in the case of a losing hand.

The step of one of the players selecting a joker card which is preferably accomplished with the help of electronic means comprises the following substeps:

a) formation of a plurality of (N+M) elements consisting of subplurality N of elements $n_{ij}$ where N=52, i=1 . . . 13, j=1 .. . 4, and subplurality M of additional elements, where M is an integral number equal to or exceeding zero, each element $n_{ij}$ of subplurality N representing the code of a definite card of a 52-card deck characterized by sign (i) corresponding to one of the nominal values of 13 cards and sign (j) corresponding to one of the four card suits, and each additional element of subplurality M representing the code of the textual data block assuring personal priority of the croupier or any of the players;

(b) random selection of one of the elements of plurality (N+M); and (c) presentation on the display of the result of said selection for a given hand.

The step of selecting a joker card for a given hand preferably includes a presentation to the players of the joker card on an electronic indicator in the form of a graphic image of the card symbol corresponding to random-selected code $n_{ij}$, or in the form of a textual data block corresponding to one of the deck cards.

Besides, the step of the assessment of the remaining players' game combinations is preferably based on the use of the following priority or rank order of winning poker hands as a criterion: Five of a Kind, Royal Flush, Straight Flush, Four of a Kind, Full House, Flush, Straight, Three of a Kind, Two Pair, One Pair, and includes transformation of the joker+One Pair game combination into the Three of a Kind combination for a pair of cards from two twos to two sevens, and into the Two Pair game combination for a pair of cards from two eights and higher, where the joker card forms a second pair with the higher card of the remaining two cards.

The objects of the present invention indicated above are also accomplished by the provision of an apparatus (facilities) for selection of a joker card in poker game, said facilities comprising a gaming table, an electronic selection device arranged on the gaming table, a Stop button designed for inserting an instruction into the electronic selection device to write the code and indicate the selected card, and a Start button designed for inserting an instruction into the electronic selection device to clear the indication of the previously selected card and write the code of the new card.

The electronic selection device preferably comprises a master clock pulse oscillator; a counter with switchable feedbacks said counter being connected through its clock pulse input to the master clock pulse oscillator output; an address register whose digit inputs are connected respectively to the digit outputs of the counter with switchable feedbacks; a read-only memory for storage of codes corresponding to deck cards, the inputs of said read-only memory being connected to the address register digit outputs; a receiving register whose digit inputs are connected to the read-only memory data outputs; a code conversion and indication unit whose inputs are connected to the receiving register digit outputs; a counter scaling factor selector switch with switchable feedbacks; a control code shaping circuit whose inputs are connected to the scaling factor selector switch of the counter with switchable feedbacks and whose outputs are connected to the setting inputs of the counter with switchable feedbacks; and a control unit whose clock pulse input is connected to the master clock pulse oscillator output and whose outputs are connected respectively to the address register write control input, the read-only memory address-storage input, the receiving register write control input and the control input of the code conversion and indication unit, said first and second control inputs of the control unit being connected respectively to the Start button and to the Stop button.

In the preferred embodiment of the apparatus the Start button is arranged on the gaming table next to the croupier's location, whereas the Stop button is mounted on a remote control console arranged on the gaming table next to one of the player's locations.

The main idea of the present invention consists in that the deck of playing cards does not include an extra card, the joker card being designated or chosen from 52 cards of the playing deck each time before dealing a new hand. A joker card may be selected by different methods, for instance, by using another deck of cards. All such methods, however, do not resolve the problem of game protection.

In the preferred embodiment of the invention the selection of the joker card is randomized by electronic means. Besides, use can be made, if necessary, of additional symbols or textual information blocks (code words) suitable for a given poker game modification and assuring personal priority of a player or a croupier.

The present invention makes it possible to modify the traditional five-card stud poker game by introducing a joker card which extends the range of game combinations thereby enhancing the advantages of a good hand, and leads to the emergence of a hitherto impossible game combination of Five of a Kind. As has been pointed out above, a simple introduction of an extra (53rd card) would entail numerous problems, including the problem of safety and the need for additional protection of the game from all sorts of cheating (e.g. marking a joker card). By contrast, the present invention completely eliminates safety problems making it possible to introduce a joker card by a special cheat-proof random selection method. In this method the joker card is brought into play as one of the already playing 52 cards and changes each time the players are dealt a new hand. It is selected by electronic means, initiated by one of the players, the choice being left to chance in accordance with the spirit of poker game. An electronic display simply shows the players a symbol, e.g. a picture of the card selected at random. Such a "virtual" joker card cannot be "marked", nor can its selection be influenced in any way, which makes the game more dramatic and exciting. What with the greater chance of success due to a higher probability of the occurrence of game combinations (which can be proved mathematically), this modification adds to the attractiveness of the game and its popularity with the public.

BRIEF DESCRIPTION OF THE DRAWINGS

The essence of the invention is explained with reference to the following drawings of its embodiment.

DETAILED DESCRIPTION OF A PREFERRED EMBODIMENT

Figure 1:
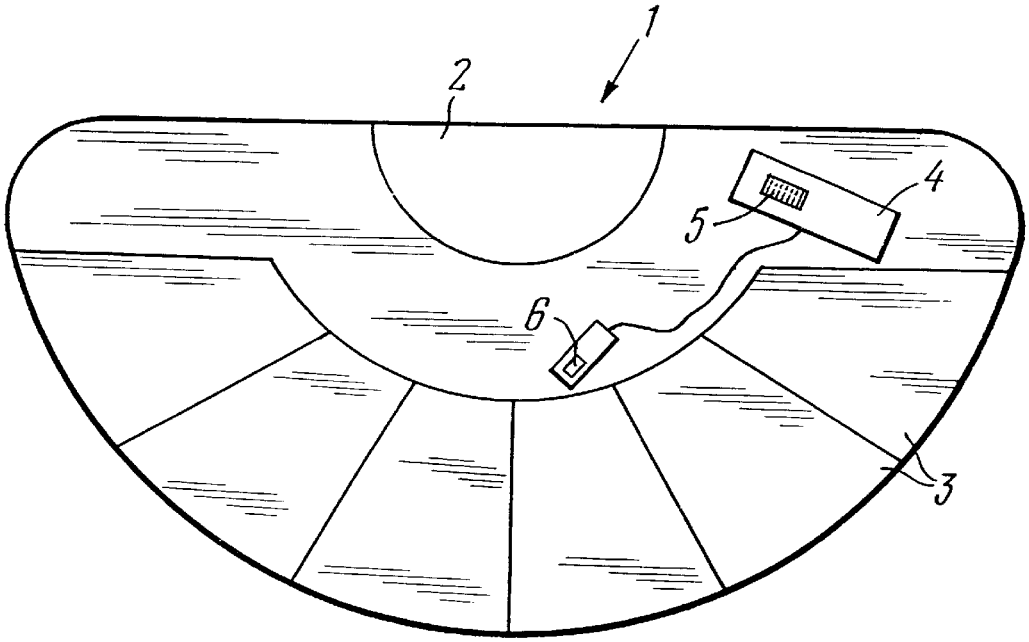
FIG. 1 is a diagrammatic representation of a facility for selection of the joker card by the disclosed method.

As is shown in FIG. 1, the facility for selection of the joker card in poker game by the disclosed method comprises gaming table 1 with croupier's location 2 and playing locations 3 for the player to make an "ante" and a "bet", a set of poker chips or other gaming tokens of different values (not shown in the drawing) whereby players make their wagers or bets, joker card electronic selection device 4 arranged on gaming table 1, Start button 5 connected to the first control input of joker card electronic selection device 4 and arranged next to croupier's location 2, Stop button 6 arranged on a remote control console on gaming table 1 next to one of playing locations 3 and connected to the second control input of joker card electronic selection device 4.

Figure 2:
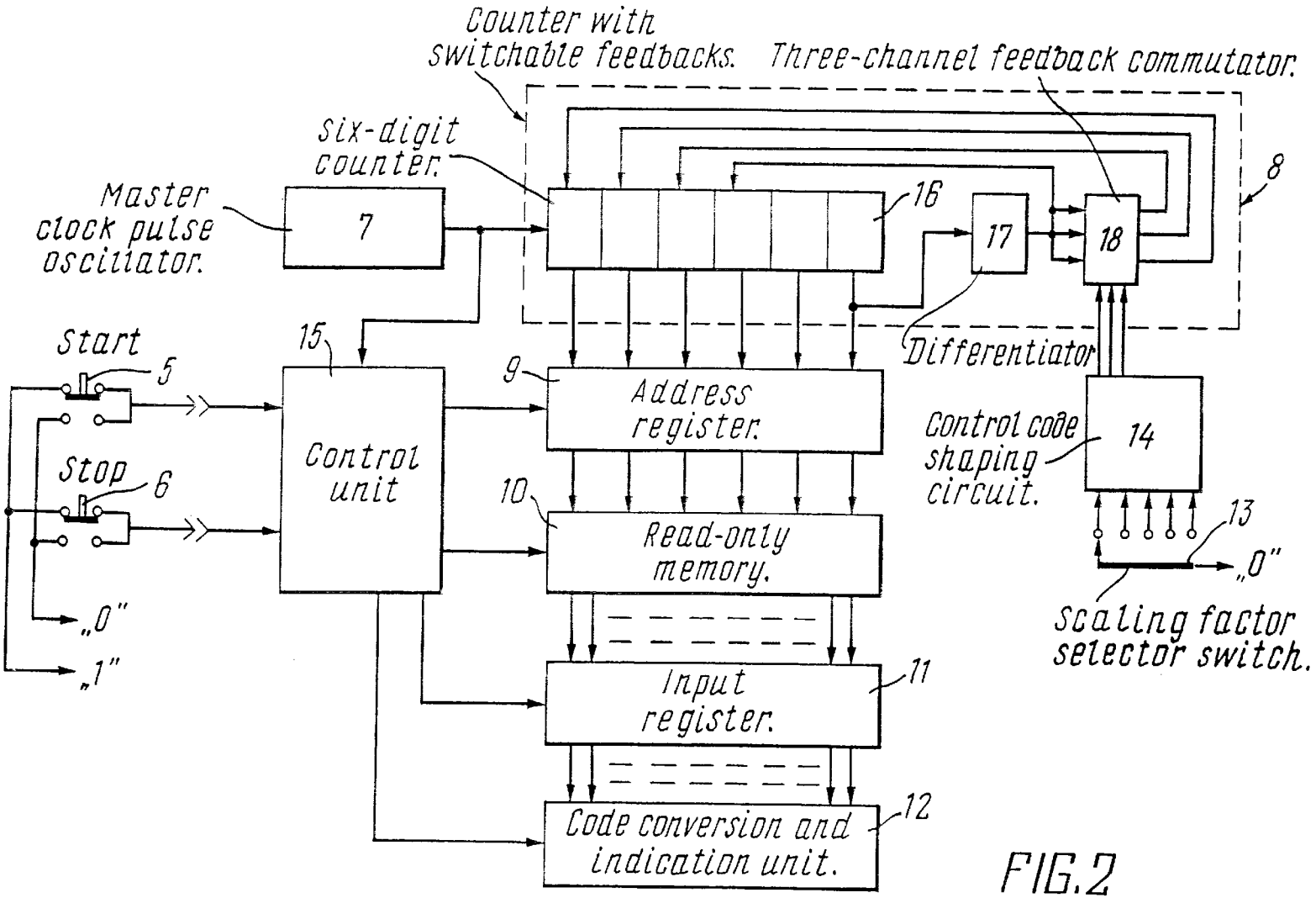
FIG. 2 is a block diagram of a possible embodiment of the electronic device for selection of the joker card by the disclosed method.

The design of a preferred embodiment of the joker card electronic selection device is illustrated in FIG. 2. The electronic selection device comprises master clock pulse oscillator 7; counter with switchable feedbacks 8 connected through its clock pulse input to the output of master clock pulse oscillator 7; address register 9 whose digit inputs are connected respectively to the digit outputs of counter with switchable feedbacks 8; read-only memory 10 for storage of codes corresponding to deck cards, the inputs of said read-only memory being connected to the digit outputs of address register 9; receiving register 11 whose digit inputs are connected to the data outputs of read-only memory 10; code conversion and indication unit 12 whose inputs are connected to the digit outputs of receiving register 11. The joker card electronic selection device also includes scaling factor selector switch 13 of counter with switchable feedbacks 8; control code shaping circuit 14 whose inputs are connected to scaling factor selector switch 13 of counter with switchable feedbacks 8 and whose outputs are connected to the setting inputs of counter with switchable feedbacks 8; and control unit 15 whose clock pulse input is connected to the output of clock pulse oscillator 7. The outputs of control unit 15 are connected respectively to the write control input of address register 9, to the address-storage input of read-only memory 10, to the write control input of receiving register 11 and to the control input of code indication and conversion unit 12. The first and the second control inputs of control unit 15 are connected respectively to Start button 5 and to Stop button 6.

In one of the embodiments of the present invention counter unit 8 with switchable feedbacks comprises six-digit counter proper 16 whose clock pulse input serves as the clock-pulse input of counter unit 8 with switchable feedbacks; differentiator 17 and three-channel feedback commutator 18 whose control inputs are connected to the setting inputs of counter with switchable feedbacks 8, and its outputs are connected via feedback buses to digit inputs of six-digit counter proper 16. The output of the last digit of six-digit counter proper 16 is connected via differentiator 17 to the input of three-channel feedback commutator 18.

The method of selection of the joker card in the poker game modification according to the invention will be described later with references to FIGS. 1 and 2. In this card game use is made of a standard deck of 52 cards. The croupier shuffles the cards, each player makes an ante to participate in the game, whereupon the croupier deals a poker hand, one card at a time, to each player and the players lay wagers in accordance with the rules of the game. Joker card electronic selection device 4 is in the initial position (before the beginning of the game the croupier depresses Start button 5). One of the players presses Stop button 6 and joker card electronic selection device 4 forms the symbol of the card which is to serve as joker for a given hand (round), and displays it on the indicator. Each player views his hand and assesses the game combination available to him versus the game combinations available to other players.

The priorities of game combinations are determined by the conventional rules of five-card poker, account being taken of the presence of the joker which, in combination with the highest card, gives a new game combination—five of a Kind, the highest winning hand. The game combinations used in the method disclosed in the present invention rank as follows: Five of a Kind, Royal Flush, Straight Flush, Four of a Kind, Full House, Straight, Three of a Kind, Two Pair, One Pair.

If a player does not wish to continue playing the hand because it has no game combination or because he decides that the rank of his game combination is lower than the ranks of other players' combinations, he folds and loses his ante. Should the player decide that his hand is higher than the hands of the remaining players, he continues playing by making a wager (bet).

The joker card selection device is universal in the sense that it can be used in practically all poker game modifications, both classic and specially adapted for a casino, for instance, the modifications described in U.S. Pat. Nos. 4,836,553, 5,288,081. Understandably, in the latter case the use of the disclosed selection device will call for changes in the poker game rules and bonus payment odds for different combinations, and will add a hitherto impossible combination, Five of a Kind, to the list of traditional hands.

We may now consider one of the embodiments of the present invention as applied to the poker game modification described in U.S. Pat. No. 4,836,553. In order to balance the game in this modification it is necessary to change its rules and terms in a radical manner. For instance, the lowest combination in the croupier's hand should be Pair of Twos and the bonus payment odds may be as follows:

| TYPE OF HAND | BONUS PAYMENT ODDS |
|---|---|
| Five of a Kind | 150:1 |
| Royal Flush | 75:1 |

-continued

| TYPE OF HAND | BONUS PAYMENT ODDS |
|---|---|
| Straight Flush | 35:1 |
| Four of a Kind | 15:1 |
| Full House | 7:1 |
| Flush | 5:1 |
| Straight | 4:1 |
| Three of a Kind | 3:1 |
| Two Pair | 2:1 |
| One Pair | 1:1 |

The bonus payment odds indicated above represent but one of the possible alternatives for a given game. In practice odds may be different.

It is also possible to provide for a possibility of displaying textual data assuring personal priority of a player or the croupier. It can be done by using at least one additional textual code which is transformed by the joker card electronic selection device into a joker card symbol for a given hand. For instance, when using textual information of the "croupier's open card" type, the card dealt by the croupier face up becomes a joker card and the croupier gets priority in the hand for which one of the players selected the code of the aforesaid textual information through the agency of the joker-card electronic selection device. These additional opportunities do not, by any means, change the essence of the disclosed method which secures, in this particular example like in others, safety in the selection of one of the 52 cards of a standard deck of cards and enables using the new set of game combinations presented above.

The described sequence of steps is basically the same as in the traditional five-card stud poker game. However, the introduction of a poker card in accordance with the present invention leads to important changes in the given game and in the results obtained.

With the introduction of a joker card in the game the probability of no-play combinations (up to Pair of Twos and higher) in a hand diminished by 125244 out of possible 1302540. These 125244 new game combinations fall under the standard classification of poker combinations and, in accordance with the probability of their occurrence, are distributed among such combinations as One Pair, Straight, Flush, Straight Flush and Royal Flush. Besides, the proportions of different game combinations within the entire body of combinations change owing to the fact that the joker card raises some combinations to a higher level. For instance, the combination Three of a Kind with joker becomes Four of a Kind. The same happens to the Full House combination, if one of the two cards of a kind turns out to be joker. The Two Pair combinations with joker make Full House or Three of a Kind depending on whether the joker card participates in the Two Pair combination or not.

In the event that the joker card combines with One Pair, there is a high probability of the combination changing to Three of a Kind. Yet in this case there would be a probability of disproportionate increase of the number of such combinations and the Two Pair combinations would turn out to be sort of a disadvantage: the change of a certain number of the Two Pair combinations with joker to the Full House category without any compensation of the Two Pair category owing to the "promotion" of lower combinations to the Two Pair level with create a certain disbalance. For this reason the One Pair combinations changing to a higher level as a result of the appearance of the joker card may be artificially divided. The division may be carried out in different ways, yet a more balanced distribution would be attained by adopting a rule whereby the combination of joker with any pair, from Pair of Twos to Pair of Sevens should produce the Three of a Kind combination. The combination of the joker with Pair of Eights or higher should produce Two Pair where the joker together with the higher of the two remaining cards forms a second pair.

Of special importance is the selection of the joker card by electronic means and not by any other method. Firstly, electronic selection completely rules out the possibility of cheating, e.g., by surreptitiously marking an ordinary joker card or by some manipulations when dealing cards to the players. Secondly, the "electronic joker" becomes a very effective means for making the game more spectacular and attractive to the public owing in fact to the fortuitous character of the selection of the joker card for each new hand.

One of the embodiments of the joker card electronic selection device presented in FIG. 2 provides for a possibility of additionally coding textual information elements used when selecting a joker card for the next hand in accordance with the rules of game which become effective after random selection of the joker card by a player (for instance, personal priority of a player or the croupier based on bonus payments as a result of the selection of a definite card, etc.).

The electronic device used for selection of a joker and shown in FIG. 2 continuously runs through (scans) 52 code address words. Each of such words correlates with information on one of the game cards entered into read-only memory 10. The length of the information word entered into read-only memory 10 for each of the game cards is determined by the requirements of indication unit 12 selected for the game; they may be prompted, for instance, by the specificity of light emitting diode matrix circuits.

The scanning speed of the joker card electronic selection device is determined by the frequency of master clock pulse oscillator 7. Equiprobability of the selection of one of the address words is provided by counter with switchable feedbacks 8 operating in the cyclic mode. The base scaling factor of counter 8 equal to 52 is set by selector switch 13 notable for a limited operation access (such a limitation is achieved, for instance, by arranging selector switch 13 inside electronic selection device 4). The scaling factor (K) equal to 52 corresponds to zero setting position of selector switch 13. Setting positions 1–4 of selector switch 13 correspond to scaling factors 53–56. The feedbacks of counter 8 are energized and deenergized by three-channel commutator 18 controlled by selector switch 13 through commutator control code shaping circuit 14. The setting of the required scaling factor on counter with switchable feedbacks 8 consists in the entering, through the corresponding digit inputs of six-digit counter 16, of a number equal to difference $2^6-K_i$, where $K_i$ is the required scaling factor. For instance, with K=53, $2^6-53=11$, which corresponds to number $1011_{(2)}$. Consequently, with K=53 the feedbacks should be connected to the 1st, 2nd and 4th digit inputs of counter 16. The feedback signal applied to the 3rd digit input should be cut off (in FIG. 2 energized feedbacks are marked as "1", and deenergized feedbacks marked as "0". Deenergized feedbacks are connected to a logic "1" signal line).

Pressing Start button 5 which is only accessible to the croupier causes indication unit 12 to erase the data brought out earlier, switch on the search mode indication function and enable passage of the enter command to address register 9 (the entry will be made if a player presses Stop button 6).

Pressing Stop button 6 which is accessible only to a player causes the formation of a command for a single entry of data to address register 9 (the data come to the information inputs of address register 9 from digit outputs of counter 8 with switchable feedbacks). Simultaneously read-only memory 12 changes to the access (read enable) mode and the data stored in read-only memory 10 at the selected address is transferred to input register 11. After the accomplishment of these operations read-only memory 10 changes to the data storage mode and indication unit 12 begins to operate. In order to exclude the possibility of multiple rewriting by a player of the selected address, after the passage of the enter command to address register 9 control unit 15 blocks the signal coming from Stop button 6 even when said button is depressed. Stop button 6 is released only after pressing Start button 5.

Captions to FIG. 2

(5) Start button

(6) Stop button

(7) Master clock pulse oscillator

(8) Counter with switchable feedbacks

(9) Address register

(9) Read-only memory

(11) Input register

(12) Code conversion and indication unit

(13) Scaling factor selector switch

(14) Control code shaping circuit

(15) Control unit

(16) Six-digit counter

(17) Differentiator

(18) Three-channel feedback commutator

(19) Logic 0

(20) Note: Logic 1 denotes energized feedbacks, zero (0) denotes deenergized feedbacks. Scaling factor K=52. Deenergized feedbacks are connected to logic 1 signal lines.

What is claimed is:

1. A method of selecting a joker card for a poker game comprising the steps of:

all players anteing a first bet means;

a croupier dealing a certain number of physically tangible cards to the players;

one of the players selecting a joker card for a given hand by picking out at random one of the elements from a plurality of elements, each corresponding to one of the physically tangible cards in the deck to thereby identify a sole, randomly-selected joker for that hand;

each player viewing his hand and deciding whether to continue playing or to fold depending on the game combination available to him and the possibility of the randomly-selected joker card to increase the rank of his game combination;

each player either folding or remaining to continue the game;

each remaining player assessing game combinations on the basis of the established priority or rank order of winning poker hands;

each remaining player estimating his gain in the case of a winning hand, assessing the possibility of getting a new game combination of the highest rank comprising five of a kind, and paying his bet in the case of a losing hand.

2. A method according to claim 1 wherein the step of selecting a joker card is performed by electronic means and consists of the following substeps:

formation of a plurality of (N+M) elements consisting of subplurality N of elements $n_{ij}$ where N=52, i=1 . . . 13, j=1 . . . 4, and subplurality M of additional elements, where M is an integral number equal to or exceeding zero, each element $n_{ij}$ of subplurality N representing the code of a definite card of a 52-card deck said code being characterized by sign (i) corresponding to one of the nominal values of 13 cards, and sign (j) corresponding to one of the four card suits, each additional element of subplurality M representing the code of the textual data block assuring personal priority of the croupier or any of the players;

random selection of one of the elements of plurality (N+M); and presentation on the display of the result of said selection for a given hand.

3. A method according to claim 2 wherein the joker card selected for a given hand is presented to the players on an electronic indicator in the form of a graphic image of the card symbol corresponding to random-selected code $n_{ij}$, or in the form of a textual data block corresponding to one of the deck cards.

4. A method according to claim 1 wherein the step of the assessment of the players' game combinations is based on the use of the following priority or rank order of winning poker hands as a criterion: Five of a Kind, Royal Flush, Straight Flush, Four of a Kind, Full House, Flush, Straight, Three of a Kind, Two Pair, One Pair.

5. A method according to claim 4 wherein the step of the assessment of the players' game combinations includes transformation of the "Joker+One Pair" game combination into the "Three of a Kind" combination for a pair of cards from two twos to two sevens, and into the Two Pair game combination for a pair of cards from two eights and higher, where the joker card forms a second pair with the higher card of the remaining two cards.

6. An apparatus for selection of a joker in a power game, comprising:

a gaming table having a plurality of playing locations at which players may be seated and onto which physical cards are dealt;

an electronic selection device arranged on the gaming table;

a stop button designed for inserting an instruction into the electronic selection device to indicate a newly selected card to be used as a sole, randomly-selected joker;

a start button designed for inserting an instruction into the electronic selection device to clear an indication of a previously selected card and initiate selection of a new card to be used as a sole, randomly-selected joker.

7. An apparatus as claimed in claim in claim 6 wherein the electronic selection device comprises:

a master clock pulse oscillator;

a counter with switchable feedbacks, said counter being connected through its clock pulse input to the master clock pulse oscillator output;

an address register whose digit inputs are connected respectively to the digit outputs of the counter with switchable feedbacks;

a read-only memory for storage of codes corresponding to deck cards, the inputs of said read-only memory being connected to the address register digit outputs;

a receiving register whose digit inputs are connected to the read-only memory data outputs;

a code conversion and indication unit whose inputs are connected to the receiving register digit outputs;

a counter scaling factor selector switch with switchable feedbacks;

a control code shaping circuit whose inputs are connected to the scaling factor selector switch of the counter with switchable feedbacks and whose outputs are connected to the setting inputs of the counter with switchable feedbacks; and a control unit whose clock pulse input is connected to the master clock pulse oscillator output and whose outputs are connected respectively to the address register write control input, the read-only memory address-storage input, the receiving register write control input and the control input of the code conversion and indication unit, said first and said second control inputs of the control unit being connected respectively to the Start button and to the Stop button.

8. An apparatus as claimed in claim 6 wherein the Start button is arranged on the gaming table next to the croupier's location.

9. An apparatus as claimed in claim 6 wherein the Stop button is mounted on a remote control console arranged on the gaming table next to one of the players' locations.

10. A method of conducting a poker hand in which physical cards are used, comprising the steps of:

providing a deck of physical cards;

accepting an ante from each of a plurality of players;

dealing a predetermined number of physical cards to each of said plurality of players;

identifying a card within the deck of physical cards to serve as a sole randomly-selected joker for that particular hand, said card being identified by an electronic device which substantially randomly selects one of said cards to be the sole randomly-selected joker; and determining a winner of that poker hand with said identified card representing any card that a holder of that identified card wishes it to represent.

11. The method according to claim 10, wherein the step of identifying entails pressing at least one button on the electronic device.

12. The method according to claim 11, wherein the step of identifying entails pressing, by a croupier, a start button on the electronic device to initiate selection of the sole randomly-selected joker.

13. The method according to claim 12, wherein the step of identifying entails pressing, by a player, a stop button on the electronic device to terminate selection of the sole randomly-selected joker and identify a particular card to be that joker.

14. The method according to claim 11, wherein the step of identifying entails pressing, by a player, a stop button on the electronic device to terminate selection of the sole randomly-selected joker and identify a particular card to be that joker.

15. The method according to claim 10, further comprising the step of accepting a bet from at least one of the players, after the sole randomly-selected joker has been identified and before the winner is determined.

16. The method according to claim 10, wherein the deck of physical cards comprises only 52 cars and no physical joker cards.

17. The method according to claim 10, wherein the step of identifying takes place before the step of dealing.

18. The method according to claim 10, wherein the electronic device displays on image of the identified card.

19. The method according to claim 10, wherein the electronic device displays text uniquely associated with the identified card.

* * * * *